US007198171B2

(12) United States Patent
Liu

(10) Patent No.: US 7,198,171 B2
(45) Date of Patent: Apr. 3, 2007

(54) LIQUID HOLDING VESSEL WITH SEPARATELY ATTACHED HANDLE

(75) Inventor: Yiu Ching Liu, Lake Oswego, OR (US)

(73) Assignee: Pacific Cornetta, Inc., Wilsonville, OR (US)

( * ) Notice: Subject to any disclaimer, the term of this patent is extended or adjusted under 35 U.S.C. 154(b) by 372 days.

(21) Appl. No.: 10/714,411

(22) Filed: Nov. 13, 2003

(65) Prior Publication Data

US 2005/0103794 A1 May 19, 2005

(51) Int. Cl.
*B65D 25/10* (2006.01)
*B65D 53/00* (2006.01)
*B65D 25/00* (2006.01)

(52) U.S. Cl. ..... 220/759; 220/767; 220/737

(58) Field of Classification Search ..... 220/759, 220/762, 770, 767, 737, 741, 710.5, 775, 220/776, 592.01, 592.09, 592.11, 592.16, 220/592.17, 592.21, 592.26, 592.28, 592.14, 220/62.12, 62.22; 215/393
See application file for complete search history.

(56) References Cited

U.S. PATENT DOCUMENTS 2,619,245 A * 11/1952 Levi ..... 215/10
3,369,687 A * 2/1968 Walls ..... 215/10
4,872,569 A * 10/1989 Bolte ..... 215/12.1
5,029,720 A * 7/1991 Bridges ..... 220/737
6,237,801 B1 * 5/2001 Liu ..... 220/592.17

* cited by examiner

*Primary Examiner*—Jes F. Pascua
*Assistant Examiner*—Shawn M. Braden
(74) *Attorney, Agent, or Firm*—Steven J. Adamson

(57) ABSTRACT

A fluid holding vessel that has a liquid holding member, a bottom attached handle and a base member. The liquid holding member may have a shell and a lining, and preferably has an exposed side wall made of plastic with a seamless surface. The principal components of the vessel may be joined by a single fastener. The handle may have an attachment end secured between the liquid holding member and a base member and a free-standing user end. The lining and/or base member may be made of a metallic material.

28 Claims, 3 Drawing Sheets

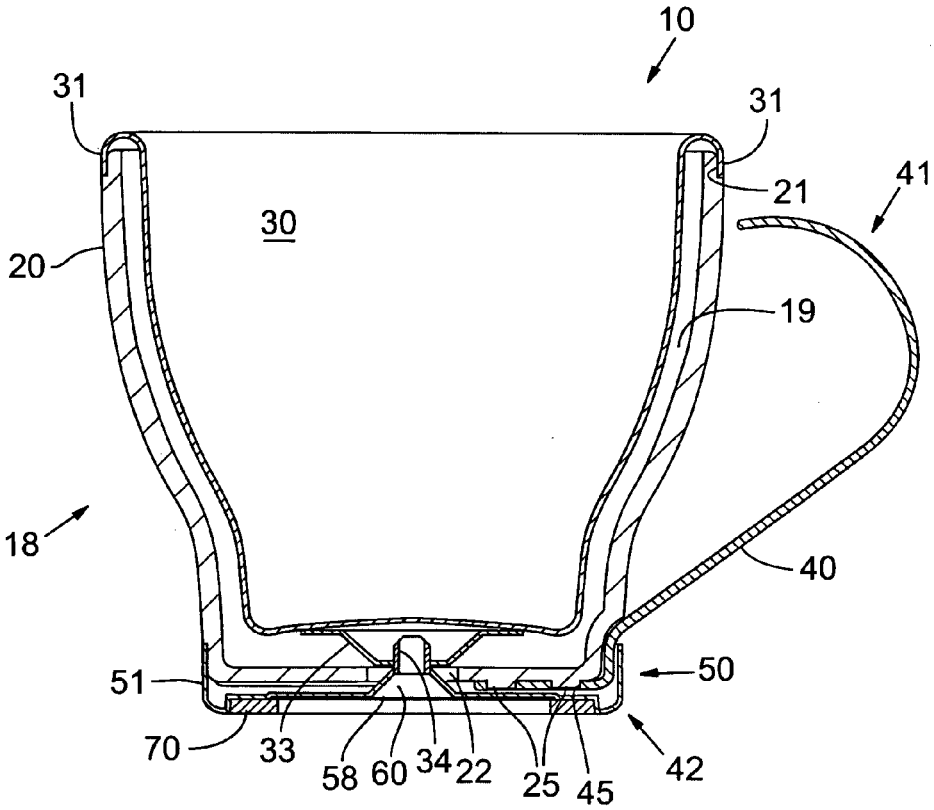
FIG. 1
FIG. 3
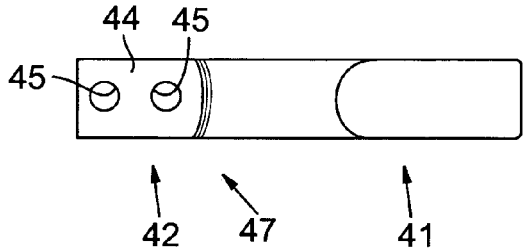

LIQUID HOLDING VESSEL WITH SEPARATELY ATTACHED HANDLE

FIELD OF THE INVENTION

The present invention relates to vessels for drinking or holding liquids. More specifically, the present invention relates to double walled vessels that may have a seamless construction or a separately attached handle or other feature.

BACKGROUND OF THE INVENTION

Vessels used in drinking or holding liquids include single and double walled tea and coffee cups and the like that have handles. These vessels may be made of plastic, ceramic, metal or other materials.

In the case of vessels that have a plastic exterior or "shell" and an integrally formed handle, these vessels will always have a fabrication "seam" that is visible on their exterior surface, typically running vertically from top to bottom. This seam is an artifact of the separation of the mold components used to shape the plastic, and may be regarded as an undesirable blemish on the exterior surface of the vessel.

With respect to non-integrally formed handles, these handles typically require machining into or through the plastic shell to mount the handle to the side of the vessel. The prior art does include vessels with handles that attach towards the top of the vessel and descend downward. In these vessels, the plastic shell is usually compromised by drilling to mount the handle through the plastic.

A need exists for a fluid holding vessel that has a handle and a seamless, uncompromised plastic exterior. A need also exists for a vessel that incorporates bottom handle attachment. A need further exists for a vessel that achieves an efficient, economical design and an attractive appearance.

SUMMARY OF THE INVENTION

The present invention is directed towards providing a liquid holding vessel that overcomes the shortcomings of the prior art and delivers other beneficial features.

In one embodiment, a liquid holding vessel of the present invention may include a liquid holding member having an exposed exterior surface formed of plastic with no visible seam; a separately formed handle that is coupled to the liquid holding member at a bottom region thereof; and a base member coupled substantially below the liquid holding member and the handle. These components may be joined by a single fastener, and the liquid holding member need not be formed of plastic. The handle may have a free-standing user end.

In another embodiment, a liquid holding vessel of the present invention may include a shell formed of plastic; a lining formed separately from the shell and positioned at least in part within the shell; a handle member extending from a base region of the vessel; and a base member fixedly coupled to at least one of the shell and lining in such a manner as to secure the handle.

These and related objects of the present invention are achieved by use of a liquid holding vessel with separately attached handle as described herein. Note that the above described embodiments are merely illustrative and not limiting.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIGS. 1 and 2 are unexploded and exploded cross-sectional side views of a liquid holding vessel in accordance with the present invention.

FIG. 3 is a top view of the handle of the vessel of FIGS. 1 and 2.

DETAILED DESCRIPTION

Figure 2:
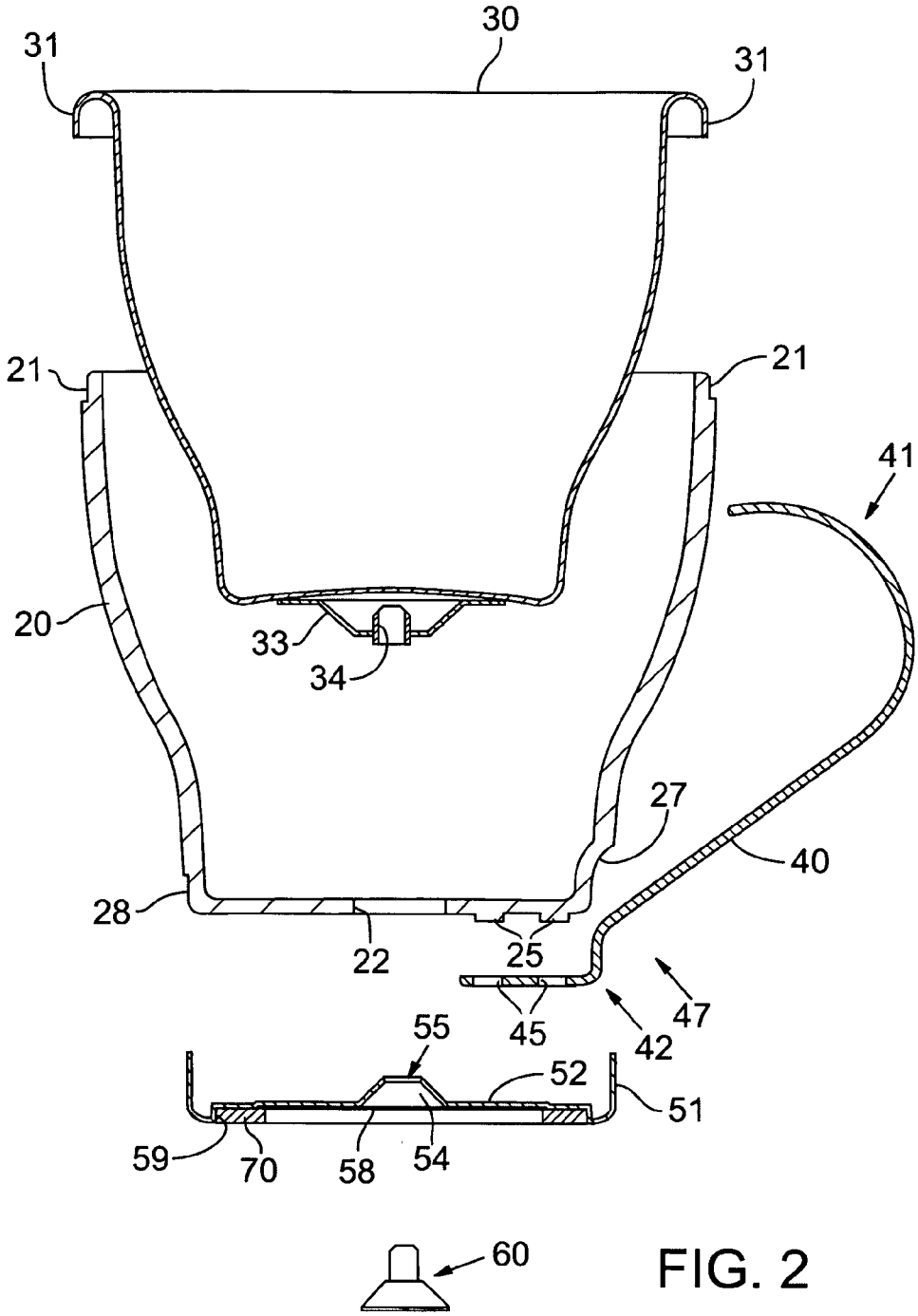

Referring to FIGS. 1 and 2, unexploded and exploded cross-sectional side views of a liquid holding vessel 10 in accordance with the present invention are respectively shown.

Vessel 10 includes a liquid holding member 18 configured to hold a liquid. The liquid holding member may be single walled as in FIG. 4 below or double walled. The double walled embodiments, shown for example in FIGS. 1 and 2, may include a shell 20 and a lining 30 preferably, but not necessarily, separated at least in part by a gap 19. Gap 19 preferably has insulative value and may be air filled or filled with an insulative material such a foam or other suitable material. Several suitable insulative materials are known in the art. Vessel 10 may also include a handle member 40 and a base member 50.

Shell 20 may be formed of any suitable material (metal, plastic, ceramic, etc.), though in at least one embodiment shell 20 is formed of plastic. Various plastic materials and fabrication techniques are known in the art. A fabrication technique in which shell 20 is formed without a seam in its exposed exterior surface is preferred, e.g., the side wall is seamless. Injection molding techniques that accomplish this objective are known in the art. Shell 20 may include a fastener opening 22 or other opening in a bottom section thereof.

Lining 30 is preferably formed of a metallic material. Suitable metallic materials include stainless steel, aluminum, titanium, alloys thereof (e.g., tin) and any other food safe metal. Advantageous aspects of stainless steel include that it provides structural integrity, resists stains, may be cleaned to a high sanitary standard and is relatively affordable. Accordingly, stainless steel may be more preferred in some embodiments or applications.

It should be recognized that lining 30 may also be made of other material. For example, lining 30 may be formed of any suitable plastic or other material. Suitable plastics for lining beverage containers are known in the art.

Lining 30 preferably has a lip 31 that extends over the top edge of shell 20 into a circumferentially disposed recess or indentation 21 formed in the outer top edge of the shell. This configuration serves to secure the top of shell 20 to the top of lining 30 when the shell is pushed into back folded lip 31 (for example, due to the force exerted by fastener 60 discussed below). This configuration also achieves a certain visual effect with a top border (and bottom border from base member 50) and may protect the top edge of the shell from damage during a fall.

Lining 30 may have a fastener receiving member 33 attached at a bottom region thereof. This member may be welded (if metallic), glued, press fit, or otherwise attached to the lining and may include a threaded or otherwise configured section 34 for receiving a threaded fastener or a rivet or another type of fastener (or provide a surface for gluing, etc.).

Handle 40 is preferably formed of a metallic material, and more preferably stainless steel, but any suitable metal (including those discussed above and others), plastic, wood or other material may be used. Handle 40 may include a user section 41 and an attachment section 42. User section 41 has a configuration that permits grasping and holding by the fingers or hand of a user.

Attachment end 42 may have any suitable configuration, though in the embodiment of FIGS. 1 and 2 has a mounting portion 44 with two bore openings 45. These bore openings each receive a mounting protrusion 25 that descends from and is preferably integrally formed with the shell. As discussed in more detail below, mounting portion 44 is pushed onto protrusions 25 and "sandwiched" between the bottom of the shell and the base plate of base member 50 (see below). In this manner, handle 40 is securely held. While the protrusion and corresponding bore opening arrangement is advantageous in simplicity of assembly, it should be recognized that (1) other protrusion-opening arrangement may be utilized, including protrusion(s) originating on the base plate or mounting portion, and (2) handle 40 may be glued or screwed or otherwise attached to shell 20.

Handle 40 may include a bent portion 47 where the handle transitions from the attachment section 42 to the user section 41. In bent portion 47, the handle may bend upward and outward over a base member discussed below and through a complementary channel 27 provided in shell 20.

As a bottom attached handle, handle 40 provides a different feel than a top mount handle. Handle 40 may be regarded as providing a more balanced feel because more fingers are typically involved in holding a bottom mount handle than a top mount handle.

A base member 50 may be provided substantially below the shell, lining and handle. Base member 50 may include a side wall or lip 51, a base plate 52, a fastener recess 54, and a fastener opening 55. A fastener 60 may be provided in recess 54 and aligned with fastener openings 55 in the base member and fastener opening 22 in the shell. Fastener 60 is threaded into or otherwise mounted into fastener receiving member 33 to attached to lining 30. As fastener 60 is tightened, base member 50 is pulled towards the lining, thereby securing the base member and lining onto the shell and securing the mounting portion of handle 40 onto protrusions 25 (via the mounting force exerted by base plate 52). This configuration achieves a mounting of four components with a single fastener.

FIGS. 1 and 2 illustrate a base member with side walls that ascend upward into a bottom circumferential groove or recess 28 in shell 20 (similar to recess 21). Recess 28 is not shown in the lower right hand corner of FIG. 1 because channel 27 is present for the width of handle 40. Recess 28 permits side wall 51 and the shell exterior to be generally flush, if desired. Side wall 51 also creates paired trim with lip 21. Nonetheless, it should be recognized that side wall 51 is optional and base member 50 could terminate with base plate 52 or be otherwise configured.

Base member 50 may have a fastener seal 58 provided over fastener 60 to effectively hide the fastener. This seal prevents users from tampering with the fastener and may provide a desired cosmetic finish. Various seals, including adhesive attached metal foil seals, are known in the art. Base member 50 may also include a recess 59 that accommodated a non-skid pad 70. The non-skid pad may be provided whether or not there is a corresponding recess, and various non-skid pad materials, shapes and mounting techniques are known in the art. Pad 70 in FIGS. 1 and 2 has an open-disk or "donut" shape.

Referring to FIG. 3, a top view of handle 40 of FIGS. 1 and 2 is shown. FIG. 3 illustrates bore openings 45 in mounting portion 44. It also illustrates features of user section 41 and bent portion 47.

Figure 4:
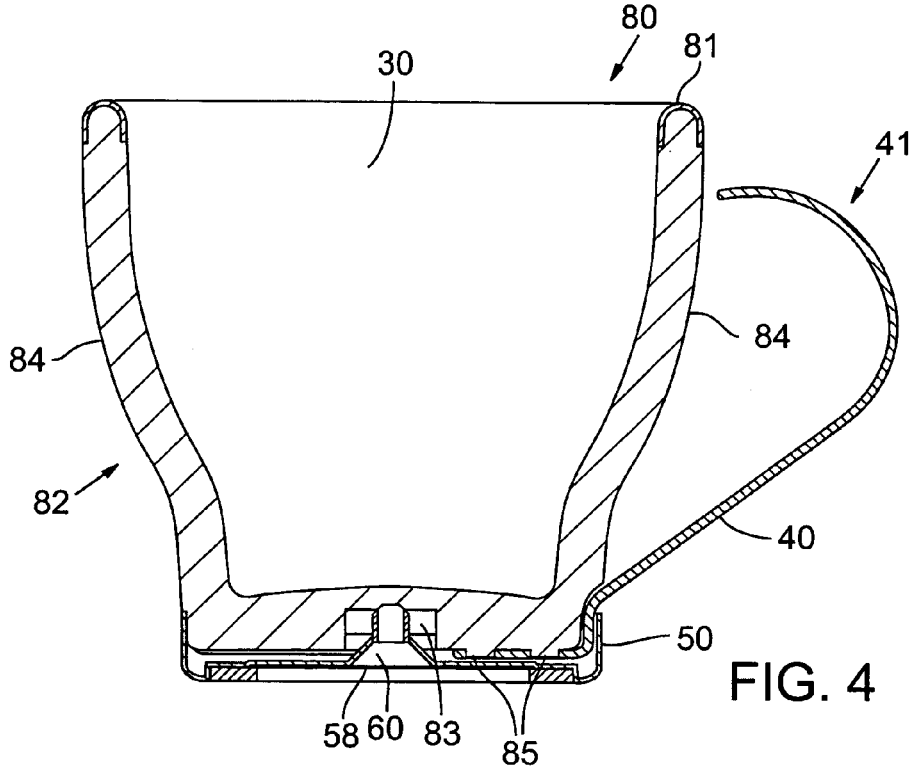
FIG. 4 is a cross-sectional side view of an alternative embodiment of a liquid holding vessel in accordance with the present invention.

Referring to FIG. 4, a cross-sectional side view of another embodiment of a liquid holding member 80 in accordance with the present invention is shown. Vessel 80 includes a liquid holding member 82 that is single walled and may be made of plastic, ceramic, metal or other material. In one embodiment, member 82 includes an exposed side wall 84 that is made at least in part of plastic and formed in such a manner as to have no visible seams. A lip 81 may optionally be provided at the top of the liquid holding member (crimped and/or glued in place) for protection or aesthetics, etc.

A fastener receiving member 83 is preferably attached to the liquid holding member 82 for receiving a fastener 60 and handle mounting protrusion 85 (like protrusions 25) are preferably provided for attaching handle 40.

The handle 40 and base member 50 may be formed as discussed above. In this embodiment, the three principal components (the liquid holding member, handle and base member) may be securely joined by a single fastener. The liquid holding member, if made of plastic, may also be formed with a seamless exposed exterior, yet possess a handle.

A fastener seal and non-skid pad 58,70 (such as those discussed with reference to FIGS. 1 and 2) may be provided.

Figure 5:
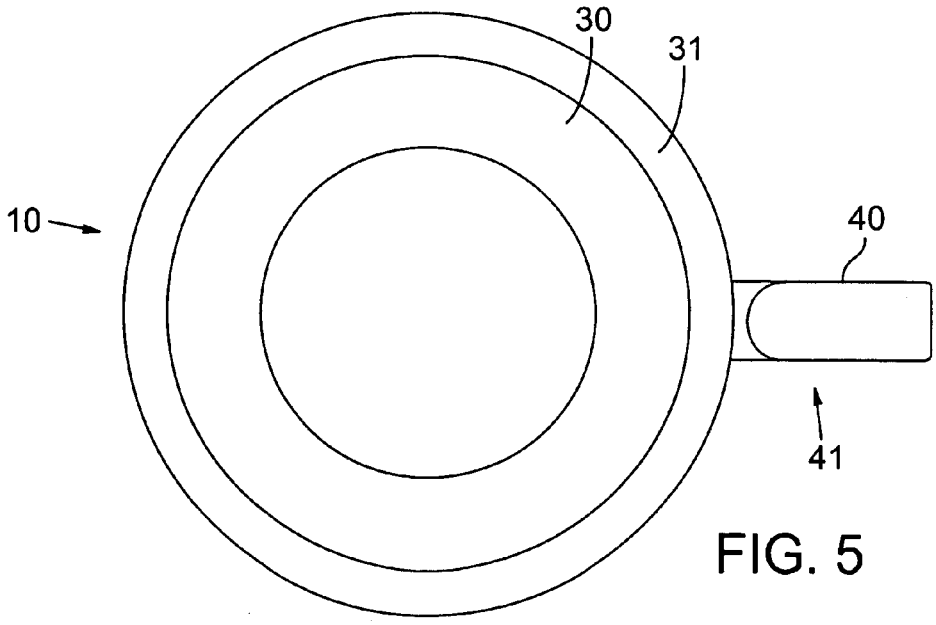
FIG. 5 is a plan view of the liquid holding vessel of FIGS. 1 and 2.

Referring to FIG. 5, a plan view of vessel 10 of FIGS. 1 and 2 is shown. FIG. 5 illustrates a circular shape, though other shapes are suitable. Lining 30 and top lip 31 are shown as is the user section 41 of handle 40.

The present invention as described herein provides may beneficial features and advantages. These include, but are not limited to, provision of a liquid holding vessel that may have a seamless or otherwise uncompromised exterior, that may have principal components joined with a single fastener and that may possess and an attractive appearance and efficient design.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A liquid holding vessel, comprising:

a liquid holding member having an exposed exterior surface formed of plastic with no visible seam;

a separately formed handle that is coupled to said liquid holding member at a bottom region thereof; and a base member coupled to said liquid holding member substantially below said liquid holding member and said handle;

wherein said handle has a first end that is coupled to said liquid holding member and an opposing end that is free standing and configured for being held by a user, said first end being positioned between said base member and a bottom of said liquid holding member.

2. The vessel of claim 1, further comprising a fastener coupled through said base member to said liquid holding member in a manner that secures said handle between said base member and said liquid holding member.

3. The vessel of claim 1, wherein said liquid holding member includes a shell and a separately formed lining.

4. A liquid holding vessel, comprising:

a liquid holding member;

a handle having a first end that is coupled to said liquid holding member at a bottom thereof;

a base member provided substantially below said liquid holding member; and a single fastener that secures said liquid holding member, said handle and said base member;

wherein said liquid holding member includes a shell and a separately formed lining; and wherein said lining and said base member are formed of metallic material, and said lining has a top lip that extends over a top edge of said shell and said base member has a bottom lip that extends beyond a bottom edge of said shell.

5. The vessel of claim 3, wherein said lining is formed of a metallic material.

6. The vessel of claim 3, further comprising a single fastener that in cooperation with the configuration of the liquid holding member and handle fixedly secures said lining, shell, handle and base member.

7. The vessel of claim 3, wherein said lining has a top lip that extends over a top edge of said shell and said base member has, a bottom lip that extends beyond a bottom edge of said shell.

8. The vessel of claim 3, wherein said one of said shell and said handle includes a protrusion and the other of said shell and said handle includes a corresponding recess, the protrusion engaging the recess for securing said handle to said shell.

9. A liquid holding vessel, comprising:

a liquid holding member;

a handle having an attachment end that is coupled to said liquid holding member at a bottom thereof and a handle end to be held by a user during use;

a base member provided substantially below said liquid holding member and configured with said liquid holding member and said handle to obscure the attachment end of said handle from view; and a single fastener that in cooperation with the configuration of the liquid holding member and handle fixedly secures said liquid holding member, said handle and said base member.

10. The vessel of claim 9, wherein said base member is mounted to said liquid holding member in a manner that secures the attachment end of said handle substantially between said liquid holding member and said base member, and the handle end of said handle is free standing and configured for being held by a user.

11. The vessel of claim 9, wherein said liquid holding member includes a shell and a separately formed lining.

12. The vessel of claim 11, wherein said shell has an exposed exterior surface formed of plastic with no visible seam.

13. The vessel of claim 11, wherein said lining is formed of a metallic material.

14. The vessel of claim 11, wherein said lining and said base member are formed of metallic material, and said lining has a top lip that extends over a top edge of said shell and said base member has a bottom lip that extends beyond a bottom edge of said shell.

15. The vessel of claim 11, wherein said single fastener secures said lining, shell, handle and base member.

16. A liquid holding vessel, comprising:

a liquid holding member;

a handle having an attachment end that is coupled to said liquid holding member at a bottom thereof;

a base member provided substantially below said liquid holding member and said handle member; and wherein said base member is mounted to said liquid holding member in a manner that secures said handle substantially between said liquid holding member and said base member;

wherein said liquid holding member includes a shell and a separately formed lining; and wherein said lining and said base member are formed of metallic material, and said lining has a top lip that extends over a top edge of said shell and said base member has a bottom lip that extends beyond a bottom edge of said shell.

17. The vessel of claim 16, wherein the attachment end of said handle is coupled to said liquid holding member and an opposing user end of said handle is free standing and configured for being held by a user.

18. The vessel of claim 17, wherein said shell has an exposed exterior surface formed of plastic with no visible seam.

19. The vessel of claim 17, wherein said lining is formed of a metallic material.

20. The vessel of claim 17, wherein said base member is configured with said liquid holding member and said handle to obscure the attachment end of said handle from view.

21. The vessel of claim 16, further comprising a single fastener that securely holds said lining, shell, handle and base member.

22. A fluid holding vessel, comprising:

a shell formed of plastic;

a lining formed separately from said shell and positioned at least in part within said shell;

a handle member extending from a bottom region of said vessel; and a base member fixedly coupled to at least one of said shell and lining;

wherein the handle is attached between the base and a bottom of the lining and maintained in a fixed position at least in part by the compressive force exerted by the coupling of the base to one of the shell and lining.

23. The vessel of claim 22, wherein there is no visible seam on the exposed exterior surface of said shell.

24. The vessel of claim 22, wherein said lining includes a metallic material.

25. The vessel of claim 22, wherein said handle has a first end that is coupled between said shell and base member and an opposing end that is free standing and configured for being held by a user.

26. The vessel of claim 22, wherein said lining and said base are formed of metallic material, and said lining has a top lip that extends over a top edge of said shell and said base member has a bottom lip that extends beyond a bottom edge of said shell.

27. The vessel of claim 22, further comprising a non-skid pad coupled to said base member.

28. The vessel of claim 22, further comprising a single fastener that securely holds said lining, shell, handle and base member.

* * * * *